US007040782B2

(12) United States Patent
Mayer

(10) Patent No.: US 7,040,782 B2
(45) Date of Patent: May 9, 2006

(54) OFF-AXIS PARABOLIC REFLECTOR

(75) Inventor: Mark J. Mayer, Sagamore Hills, OH (US)

(73) Assignee: GELcore, LLC, Valley View, OH (US)

( * ) Notice: Subject to any disclaimer, the term of this patent is extended or adjusted under 35 U.S.C. 154(b) by 94 days.

(21) Appl. No.: 10/782,694

(22) Filed: Feb. 19, 2004

(65) Prior Publication Data

US 2005/0185409 A1 Aug. 25, 2005

(51) Int. Cl.
*F21V 7/00* (2006.01)

(52) U.S. Cl. ..... 362/350; 360/346; 360/518; 360/348; 360/347; 360/297

(58) Field of Classification Search ..... 362/600, 362/350, 612, 555, 297, 346, 518, 348, 347
See application file for complete search history.

(56) References Cited

U.S. PATENT DOCUMENTS 3,179,898 A * 4/1965 Meltzer ..... 372/72
5,136,483 A * 8/1992 Schoniger et al. ..... 362/545
5,698,866 A 12/1997 Doiron et al.
6,042,250 A * 3/2000 Stragnola ..... 362/297
6,109,772 A * 8/2000 Futami et al. ..... 362/517
6,386,743 B1 * 5/2002 Futami et al. ..... 362/516
6,497,500 B1 12/2002 Bradford
6,508,562 B1 1/2003 Venkatram et al.
6,561,678 B1 5/2003 Loughrey
6,603,243 B1 8/2003 Parkyn et al.
6,641,284 B1 11/2003 Stopa et al.
6,644,841 B1 11/2003 Martineau
2002/0149929 A1 10/2002 Evans et al.
2003/0117789 A1 * 6/2003 Nowak ..... 362/27
2004/0042209 A1 * 3/2004 Wehner et al. ..... 362/247
2004/0145910 A1 * 7/2004 Lisowski ..... 362/519

* cited by examiner

*Primary Examiner*—Anabel Ton
(74) *Attorney, Agent, or Firm*—Fay, Sharpe, Fagan, Minnich & McKee, LLP

(57) ABSTRACT

A lamp (8, 108, 208) includes a reflector (10, 110, 210) with a plurality of off-axis reflector segments (20, 22, 24, 120*a*, 120*b*, 220). Each off-axis reflector segment has a focus at a perimeter (12, 112, 112*a*, 112*b*, 212) of the reflector. A plurality of light emitting elements (40, 42, 44, 140*a*, 140*b*, 240) are disposed at the foci of the off-axis reflector segments.

17 Claims, 5 Drawing Sheets

OFF-AXIS PARABOLIC REFLECTOR

BACKGROUND

The present invention relates to the lighting arts. It especially relates to illuminators, spot lights, overhead lamps, and other light sources that employ a plurality of light emitting diodes, and to reflectors for such light sources, and will be described with particular reference thereto. However, the invention will also find application in conjunction with light sources that employ a plurality of light emitting elements other than light emitting diodes, such as miniature lamps, semiconductor lasers, and the like. The invention will still further find application in conjunction with reflectors for such other light sources.

Conventional parabolic reflectors are designed for use in conjunction with a single, high brightness light emitting element such as an incandescent filament. The high brightness light emitting element is placed at a focal point of the reflector, and the parabolic reflector geometry causes light rays emanating from the focal point to be directed outward from the reflector opening or aperture as a generally collimated beam of light. Some beam divergence, which may be desirable for certain applications, can be obtained by arranging the incandescent filament in a "defocused" position a selected distance away from the focus. Moreover, a spherical reflector or other generally collimating reflector may be used instead of the parabolic reflector. A spherical reflector does not provide complete collimation, and so the beam produced using a spherical reflector has some divergence.

Existing light emitting diodes are generally not as bright as incandescent filaments. To produce a high brightness light source using light emitting diodes, it is generally advantageous to employ a plurality of light emitting diodes whose combined light output is comparable to or exceeds the output of a single high brightness incandescent filament. Replacing the incandescent filament with light emitting diodes has certain advantages, such as improved distribution of heat dissipation, higher reliability, and improved ruggedness of the light source.

However, the parabolic reflector commonly used for incandescent lamps is difficult to adapt for use with a plurality of light emitting elements. This is because it is difficult to arrange all the light emitting elements close to the focal point of the parabolic reflector. Those light emitting elements that are arranged some distance away from the reflector focus are not well collimated by the parabolic, spherical, or other generally collimating reflector.

One approach to addressing this problem is to provide a separate parabolic reflector for each light emitting diode. Each light emitting diode is arranged at the focal point of its corresponding reflector, so that the light from each light emitting diode is formed into a collimated beam of light. However, this arrangement usually produces a granularized illumination made up of a plurality of collimated "beamlets" corresponding to the plurality of light emitting elements. Such granularized illumination may be undesirable for certain applications. Moreover, the individual reflectors are arranged in an array or other closely packed configuration to provide cumulative illumination. Such an arrangement may present manufacturing difficulties.

The present invention contemplates an improved apparatus and method that overcomes the above-mentioned limitations and others.

BRIEF SUMMARY

According to one aspect, A reflector is disclosed. A sidewall defines a perimeter surrounding an interior region. A plurality of intersecting curved reflective surfaces are disposed in the interior region. Each curved reflective surface defines an off axis reflector segment having a focus disposed at the perimeter and oriented to reflect light emanating from its focus out a reflector aperture defined by the sidewall.

According to another aspect, an apparatus is disclosed. A generally concave reflector includes a plurality of off axis reflector segments. A plurality of light emitting elements correspond to the plurality of off axis reflector segments. Each light emitting element is disposed at a focus of a corresponding off axis reflector segment and is arranged to illuminate that segment.

According to yet another aspect, a lamp is disclosed. A reflector includes a plurality of off-axis reflector segments each having a focus at a perimeter of the reflector. A plurality of light emitting elements are disposed at the foci of the off-axis reflector segments.

Numerous advantages and benefits of the present invention will become apparent to those of ordinary skill in the art upon reading and understanding the present specification.

BRIEF DESCRIPTION OF THE DRAWINGS

The invention may take form in various components and arrangements of components, and in various process operations and arrangements of process operations. The drawings are only for purposes of illustrating preferred embodiments and are not to be construed as limiting the invention.

DETAILED DESCRIPTION OF PREFERRED EMBODIMENTS

Figure 1:
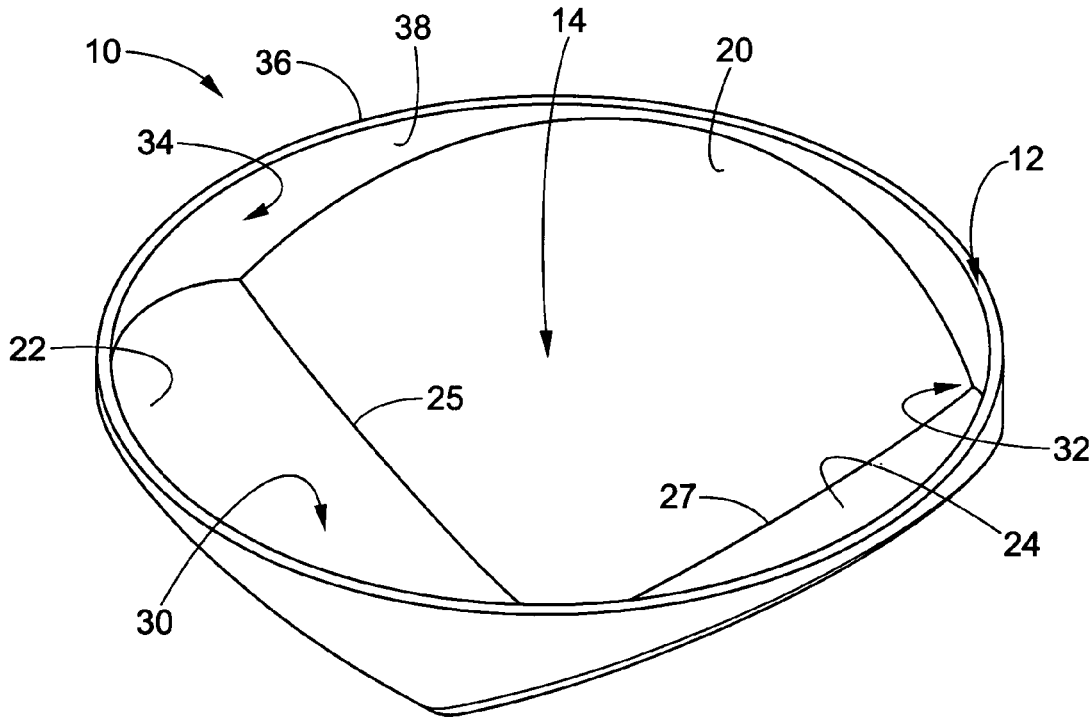
FIG. 1 shows a perspective view of a generally circular reflector.
Figure 2:
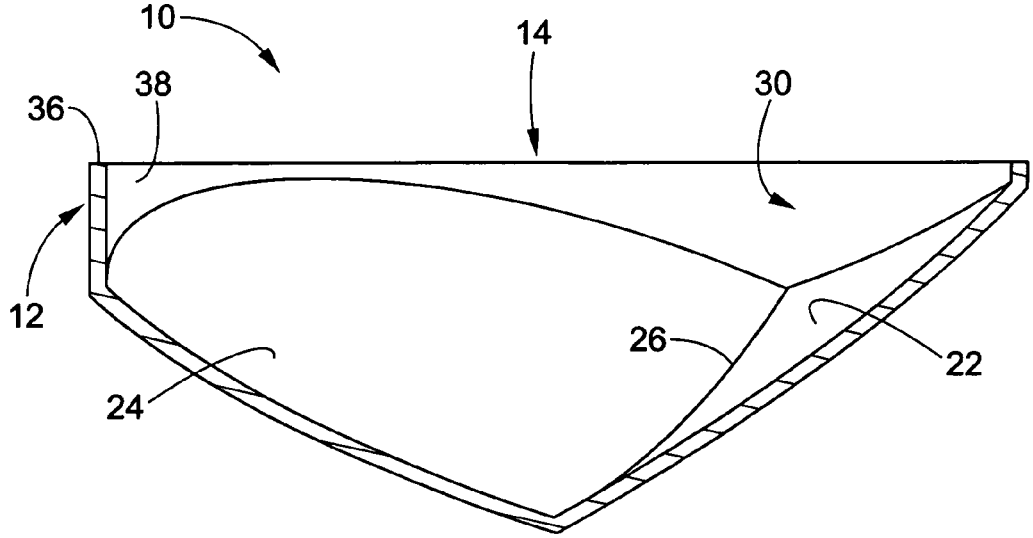
FIG. 2 shows a cross-sectional side view of the reflector of FIG. 1.
Figure 3:
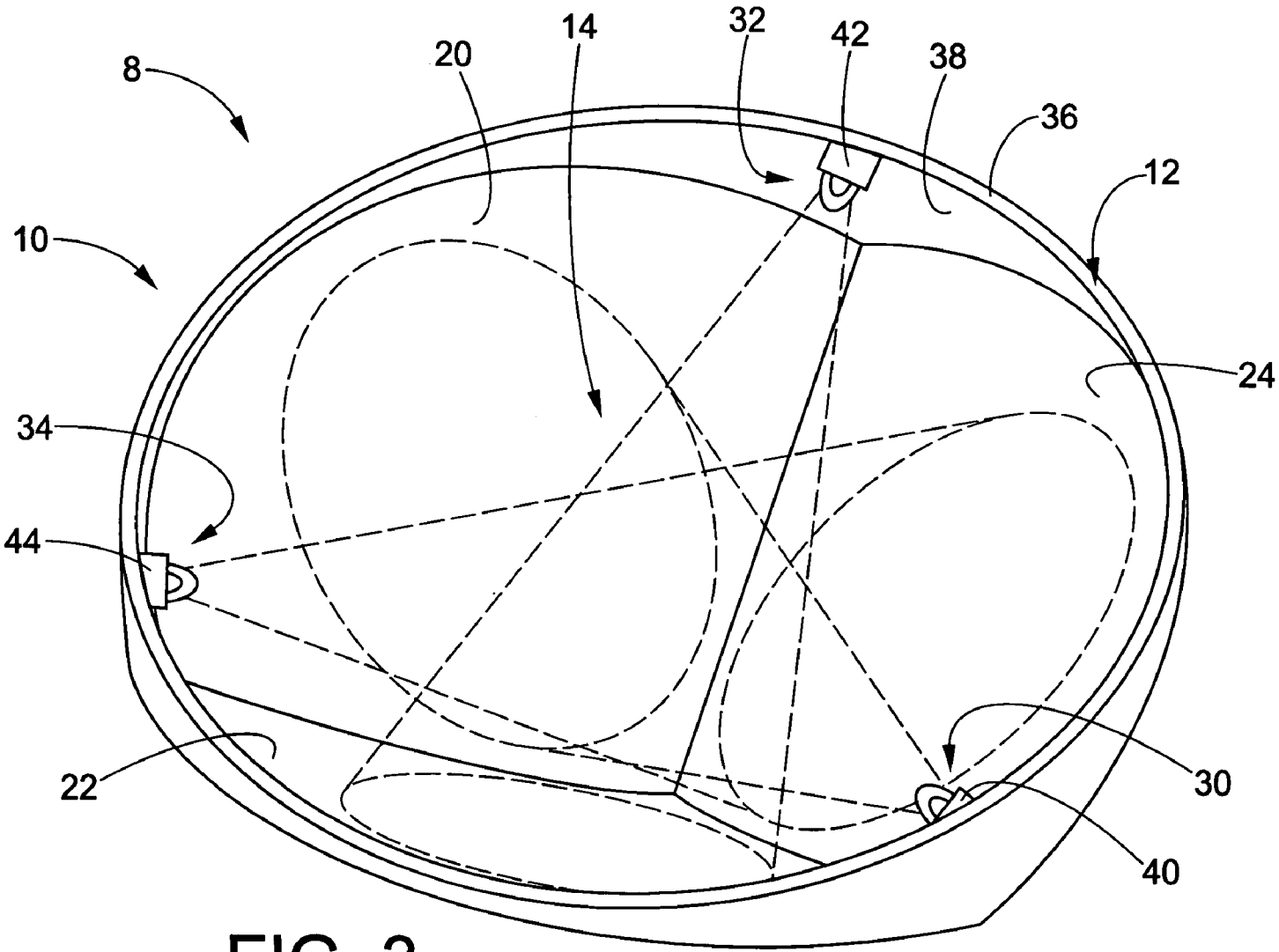
FIG. 3 shows a perspective view of a light source including three light emitting diodes and the generally circular reflector of FIGS. 1 and 2.

With reference to FIGS. 1–3, a lamp 8 includes a generally concave reflector 10 that has a generally circular perimeter 12 surrounding an interior region 14. Three intersecting off-axis reflector segments 20, 22, 24 are disposed in the interior region 14. The three off-axis reflector segments 20, 22, 24 define three lines of intersection 25, 26, 27. Intersection line 25 labeled in FIG. 1 is defined by the intersection of reflector segments 20, 22. Intersection line 26 labeled in FIG. 2 is defined by the intersection of reflector segments 22, 24. Intersection line 27 labeled in FIG. 1 is defined by the intersection of reflector segments 20, 24. The off-axis reflector segments 20, 22, 24 can be off-axis parabolic reflector segments, off-axis spherical reflector segments, another type of generally collimating off-axis parabolic reflector segment. The illustrated off-axis reflector segments 20, 22, 24 are substantially similar; however, the reflector segments can be different. For example, two segments can be parabolic while the third can be spherical.

With continuing reference to FIGS. 1–3, the off-axis reflector segments 20, 22, 24 each have a corresponding focus or focal position 30, 32, 34 disposed at the perimeter 12 of the reflector 10. A sidewall 36 is disposed along the perimeter 12. An interior surface 38 of the sidewall 36 supports light emitting elements 40, 42, 44 (shown in FIG. 3) at about the focal positions 30, 32, 34, respectively. In one embodiment, the light emitting elements 40, 42, 44 are light emitting diodes; however, miniature incandescent lamps or other compact light emitting elements can also be used.

The focal position 30, 32, 34 of each off-axis reflector segment 20, 22, 24 is disposed at a portion of the perimeter 12 defined by or lying along the two other reflector segments 20, 22, 24. The focus 30 of the off-axis reflector segment 20 is disposed at a portion of the perimeter 12 defined by the off-axis reflector segments 22, 24; the focus 32 of the off-axis reflector segment 22 is disposed at a portion of the perimeter 12 defined by the off-axis reflector segments 20, 24; and the focus 34 of the off-axis reflector segment 24 is disposed at a portion of the perimeter 12 defined by the off-axis reflector segments 20, 22. The reflector 10 and the light emitting elements 40, 42, 44 together define the lamp 8 illustrated in FIG. 3.

The light emitting element 40 at the focal position 30 of the off-axis reflector segment 20 illuminates the reflector segment 20. In FIG. 3, this illumination is indicated as a diverging cone of light emanating from the light emitting element 40, and the illuminated area or footprint of the light on the corresponding off-axis reflector segment 20 is indicated. The collimated reflected beam of light is not illustrated. In similar fashion, the light emitting element 42 at the focal position 32 of the off-axis reflector segment 22 illuminates the reflector segment 22, and the light emitting element 44 at the focal position 34 of the off-axis reflector segment 24 illuminates the reflector segment 24. In one embodiment, the off-axis reflector segments 20, 22, 24 are parabolic reflector segments defining the foci 30, 32, 34 and the light emitting elements 40, 42, 44 are substantially point light sources precisely positioned at the foci 30, 32, 34, respectively. In this embodiment, light emanating from each light emitting element 40, 42, 44 and illuminating the respective reflector segment 20, 22, 24 is reflected outward from the generally concave reflector 10 as a collimated beam of light. The generally circular perimeter 12 corresponds to an aperture of the generally concave reflector 10.

In other embodiments, the collimating geometry is partially relaxed, resulting in a diverging or otherwise incompletely collimated beam of light. For example, the light emitting elements 40, 42, 44 may be defocused relative to their respective off-axis reflector segments 20, 22, 24. Such defocusing is accomplished in one embodiment by disposing the light emitting elements a selected distance away from their respective foci 30, 32, 34, to produce a diverging lamp illumination. The light emitting elements 40, 42, 44 in most embodiments are not perfect point light sources; rather, they generally have a finite size and thus some spatial spread of the light source. Such spatial spread also typically results in incomplete collimation and some beam divergence. Still further, the off-axis reflector segments may have a spherical or other non-parabolic configuration that does not provide complete collimation even when the light emitting elements are positioned precisely at the foci. Relaxed collimation geometries such as those just described may correspond to known tolerances of the manufacturing. For some applications, however, a diverging beam may be desired. For these applications, a relaxed collimation geometry is intentionally employed to obtain some beam divergence.

Figure 4A:
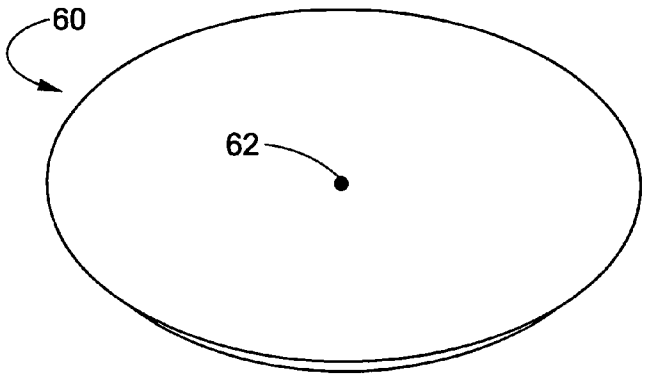
FIGS. 4A, 4B, 4C, and 4D show conceptually how the reflector of FIGS. 1 and 2 is designed.
Figure 4B:
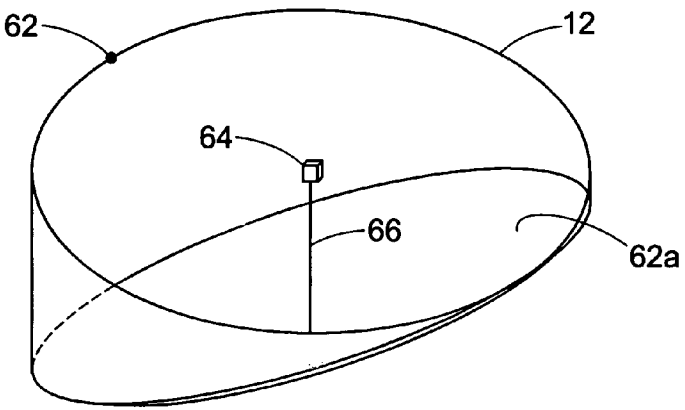

With reference to FIGS. 4A, 4B, 4C, and 4D, a suitable conceptual approach for designing the reflector 10 is described. The design approach begins with a single conceptual on-axis parabolic reflector 60 shown in FIG. 4A. The parabolic reflector 60 has a focus 62 lying on an axis of rotational symmetry of the parabolic reflector 60. As shown in FIG. 4B, the generally circular perimeter 12 is selected such that it intersects the focus 62. A projection of the generally circular perimeter 12 onto the surface of the parabolic reflector 60 defines a segment 62*a* of the parabolic reflector 60. Also indicated in FIG. 4B is a center 64 of the generally circular perimeter 12, and a projection line 66 connecting the center 64 with the projection of the center 64 onto the parabolic reflector segment 60.

Figure 4C:
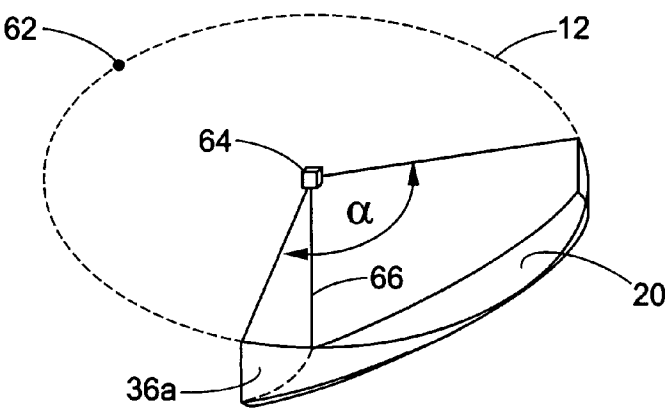
Figure 4D:
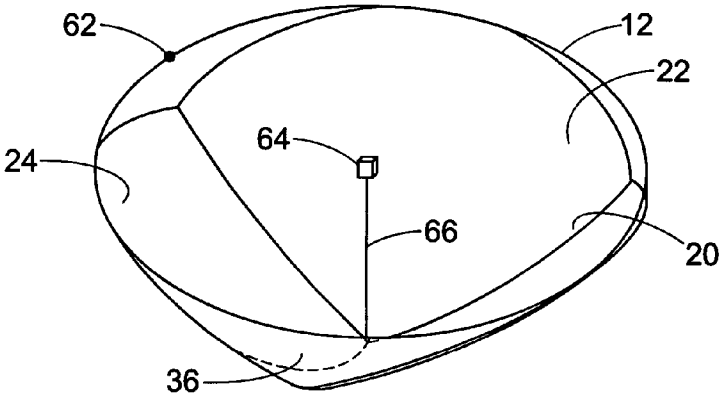

As shown in FIG. 4C, the off-axis reflector segment 20 is obtained by retaining only that portion of the segment 62*a* corresponding to an angular interval a of the generally circular perimeter 12. Because the reflector 10 includes three off-axis reflector segments 20, 22, 24, the angle $\alpha$ is selected as 120°. In general, for N off-axis reflector segments in a generally circular reflector using the present design approach, the angular interval $\alpha$ is selected as 360°/N. Thus, when designing for four off-axis reflector segments, an angular interval of 90° would be suitable. The portion 36*a* of the sidewall 36 lying along the off-axis reflector segment 20 is defined by vertical projections from the perimeter 12 to the surface of the segment 62*a* of the parabolic reflector 60. As shown in FIG. 4D, the remaining off-axis reflector segments 22, 24 are suitably designed by rotating the off-axis reflector segment 20 by 120° and by 240° about the center 64, respectively. More generally, for N off-axis reflector segments, the additional segments are suitably designed by rotating the first segment by 360°/N and integer multiples thereof. Thus, when designing for four off-axis reflector segments, rotating the first reflector segment by 90°, 180°, and 270°, respectively, would suitably position the other three off-axis reflector segments.

In another approach, the angular intervals for the segments are different. For three reflector segments, for example, three angular intervals of 100°, 120°, and 140° can be used. The total of the angular intervals should add up to 360° for a generally circular reflector. In such embodiments in which the angular intervals are not the same, the reflector will not have an N-fold rotational symmetry.

It is to be appreciated that FIGS. 4A, 4B, 4C, and 4D illustrate a conceptual approach for designing the reflector 10. The reflector can be manufactured substantially in accordance with the process illustrated in FIGS. 4A, 4B, 4C, and 4D, for example by starting with a physical reflector shaped as the on-axis parabolic reflector 60, cutting out the off-axis reflector segment 20 from that physical reflector as indicated by FIGS. 4B and 4C, repeating the process to cut out off-axis reflector segments 22, 24, securing the three off-axis reflector segments 20, 22, 24 together by welding, brazing, or another joining technique, and forming the sidewall 36 using shaped sheet metal or another process and a suitable joining technique.

In another manufacturing approach, the reflector 10 is fabricated by injection molding using a pre-shaped mold die. For example, the reflector 10 can be formed of plastic using injection molding, followed by deposition of a metal or another reflective layer or stack of layers onto the inner surface of the concave reflector 10 using vacuum evaporation, sputtering, or another suitable deposition method. In yet another manufacturing approach, the reflector 10 is formed from an aluminum or other metal blank that is shaped into the shape of the reflector 10 using a hydroform press with a punch element corresponding to the shape of the reflector 10. These manufacturing approaches are examples only; those skilled in the art can readily select other methods for manufacturing the concave reflector 10.

For illumination and other applications in which a high light intensity may be desired, the light emitting elements 40, 42, 44 are suitably operated using a relatively high power input, and may dissipate substantial amounts of heat. In some embodiments, the sidewall 36, or at least the interior surface 38 thereof, is substantially thermally conductive and provides heat sinking, or at least a thermally conductive heat removal pathway, for the light emitting elements 40, 42, 44. In other embodiments where the heat output of the light emitting elements 40, 42, 44 is lower, radiative cooling may be sufficient and so the sidewall 36 can be thermally insulating.

To provide convenient electrical wiring for the light emitting elements 40, 42, 44, the sidewall 36 may include one or more printed circuit boards that support printed circuitry for feeding electrical power to the light emitting elements 40, 42, 44. For example, planar printed circuit boards (not shown) can be mounted on the interior surface 38 of the sidewall 36, or printed circuitry can be disposed directly onto the interior surface 38 of the sidewall 36. In the latter arrangement, the interior surface 38 should be electrically insulating to provide electrical isolation for the printed circuitry. In still yet other embodiments, the light emitting elements 40, 42, 44 are electrically connected to wires passing through electrical vias (not shown) of the sidewall 36.

Figure 5:
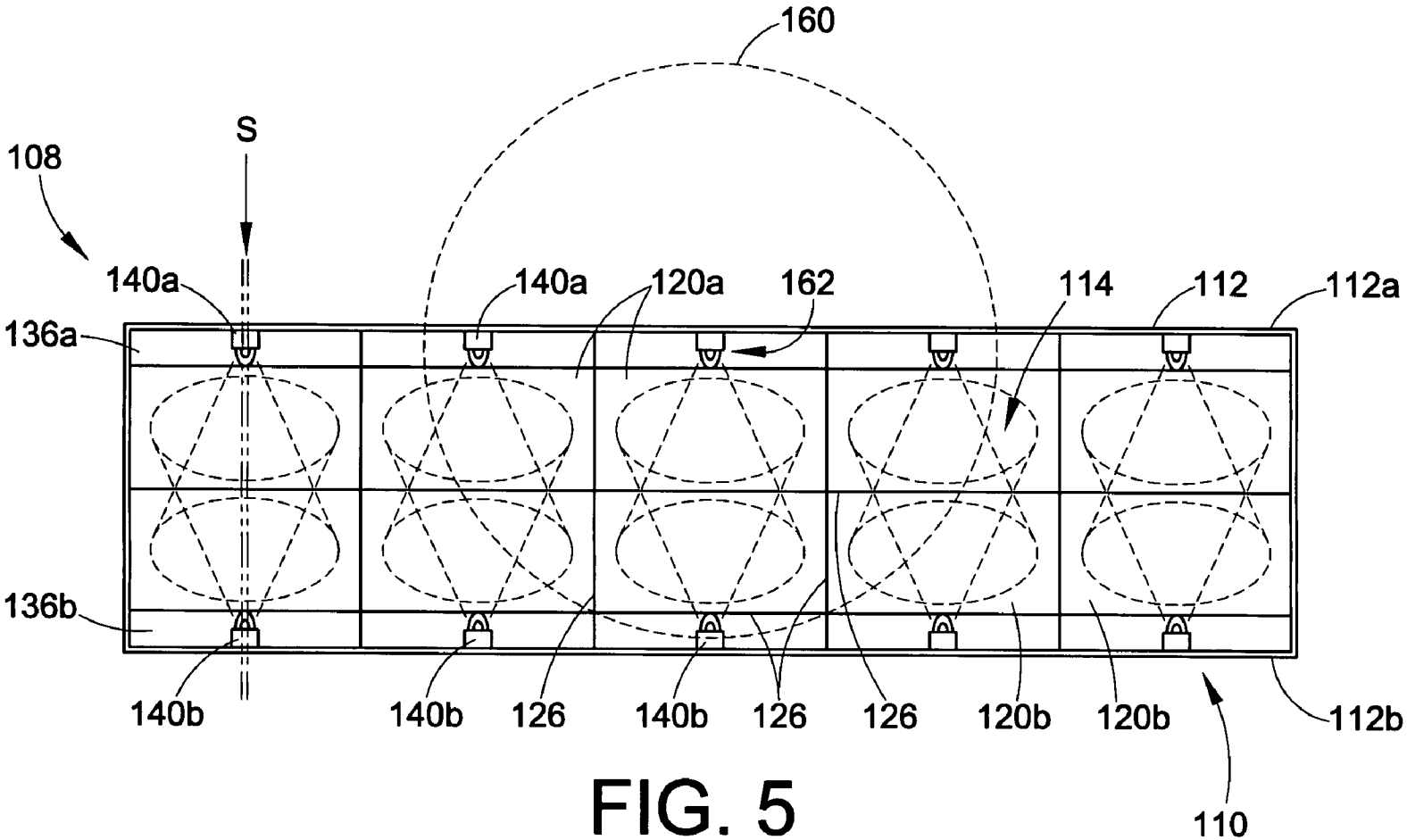
FIG. 5 shows a top view of a linear light source including a plurality of light emitting diodes and a rectangular reflector.
Figure 6:
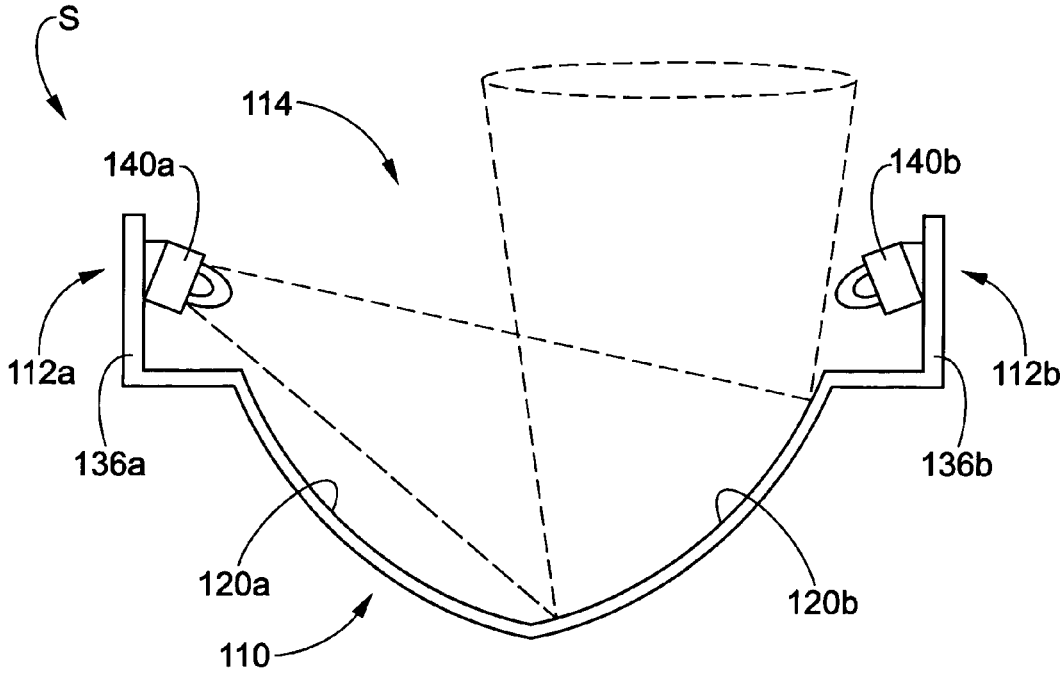
FIG. 6 shows a thin cross-sectional slice of the linear light source of FIG. 5. The thin slice S is indicated by dotted-dashed lines in FIG. 5.

With reference to FIGS. 5 and 6, a light strip or lamp 108 includes a reflector 110 that has a generally rectangular perimeter 112 surrounding an interior 114. Ten intersecting off-axis reflector segments 120*a*, 120*b* are disposed in the interior region 114. The off-axis reflector segments 120 are arranged in two rows of five segments 120 each. The first row is made up of reflector segments 120*a*, which define a long side 112*a* of the rectangular perimeter 112. The second row is made up of reflector segments 120*b*, which define a long side 112*b* of the rectangular perimeter 112.

The off-axis reflector segments 120*a*, 120*b* can be off-axis parabolic reflector segments, off-axis spherical reflector segments, another type of generally collimating off-axis parabolic reflector segment. The off-axis reflector segments 120*a*, 120*b* each have a corresponding focus or focal position disposed at the perimeter 112 of the reflector 110. An angled ledge 136*a* disposed at or near the long side 112*a* of perimeter 112 supports light emitting elements 140*a* disposed at about the focal positions of the off-axis reflector segments 120*b*, respectively.

The light emitting elements 140*a* illuminate the reflectors 120*b*, which reflect the illumination as a generally collimated beam of light. Because the light emitting elements 140*a* positioned at about the focus positions of reflector segments 120*b*, the reflected light is generally collimated. However, incomplete collimation may be present, leading for example to a diverging reflected beam as illustrated by dotted lines in FIG. 6. Incomplete collimation can be intentionally designed, for example by positioning the light emitting elements 140*a* a selected distance away from the focal positions of the off-axis reflector segments 120*b*, or by using spherical or other non-parabolic off-axis reflector segments that do not provide complete collimation.

In similar manner, an angled ledge 136*b* disposed at or near the long side 112*b* of perimeter 112 supports light emitting elements 140*b* disposed at about the focal positions of the off-axis reflector segments 120*a*, respectively. The light emitting elements 140*b* illuminate the reflectors 120*a*, which reflect the illumination as a generally collimated beam of light. Because the light emitting elements 140*b* are positioned at about the focus positions of reflector segments 120*a*, the reflected light is generally collimated, although some beam divergence is optionally designed into the lamp. The angled ledges 136*a*, 136*b* may include printed circuit boards, printed circuitry, electrical vias, or other suitable structure for electrically connecting the light emitting elements 140*a*, 140*b* to electrical power.

In one embodiment, the light emitting elements 140 are light emitting diodes; however, miniature incandescent lamps or other compact light emitting elements can also be used. The reflector 110 and the light emitting elements 140 collectively define the lamp 108. While two rows each including five off-axis reflector elements are illustrated, it will be appreciated that fewer or additional off-axis reflector segments and corresponding light emitting elements can be included to produce a linear light strip of selected length.

The reflector 110 can be designed using a procedure similar to that illustrated in FIGS. 4A–4D for the generally circular reflector 10. A suitable conceptual design approach for designing the reflector 110 is described with reference to one of the off-axis reflector segments 120*b*, which has its corresponding focal position designated as focus 162 in FIG. 5. A conceptual on-axis parabolic reflector 160 corresponding to the focus 162 is indicated in FIG. 5 by a dashed circle. Each of the other off-axis reflector segments 120*a*, 120*b*, can similarly be considered to have their focal positions designated as on-axis foci of conceptual on-axis parabolic reflectors, which will overlap substantially. The on-axis reflectors are trimmed at their intersections and are trimmed at about the generally rectangular aperture 112. Trim lines 126 for the example on-axis parabolic reflector 160 are labeled as trim lines 126 in FIG. 5. Once trimmed, the foci lie at about the perimeter 112 and are off-axis foci for the off-axis reflectors 120*a*, 120*b* defined by the trimming. For example the long side 112*a* of perimeter 112 approximately passes through the focus 162 which serves as the off-axis focus for the off-axis reflector 120*b* bounded by the trim lines 126. The perimeter 112 corresponds to a rectangular aperture of the reflector 110.

The reflector 110 can be fabricated in various ways, include sheet metal shaping, injection molding, hydroforming, and the like. When the reflector is formed of a substantially non-reflective material, a metal or other reflective coating can be deposited on the concave surfaces of the off-axis reflector segments 120*a*, 120*b* using vacuum evaporation, sputtering, or the like.

Figure 7:
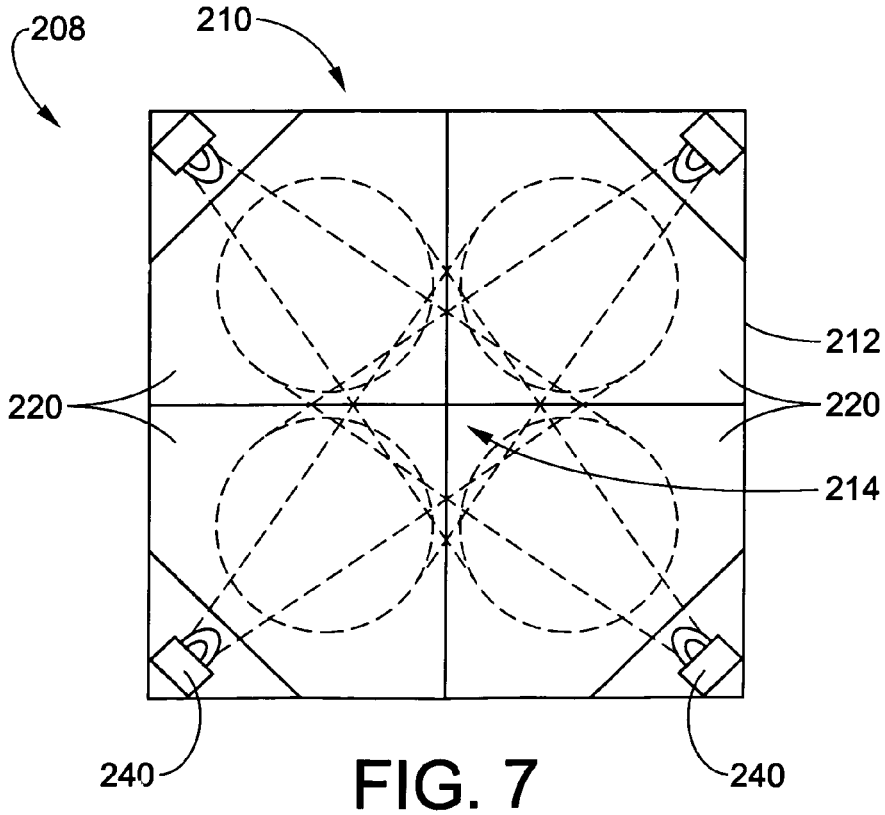
FIG. 7 shows a top view of a square light source including four light emitting diodes and a square reflector.

With reference to FIG. 7, a lamp 208 includes a reflector 210 that has a generally square perimeter 212 surrounding an interior 214. Four intersecting off-axis reflector segments 220 are disposed in the interior region 214. The off-axis reflector segments 220 are arranged in a square. The off-axis reflector segments 220 can be off-axis parabolic reflector segments, off-axis spherical reflector segments, another type of generally collimating off-axis parabolic reflector segment. Each off-axis reflector segment 220 has a corresponding focus or focal position disposed at a corner of the generally square perimeter 212 across the reflector 210 from that off-axis reflector segment 220. Light emitting elements 240, such as light emitting diodes, miniature incandescent lamps, or the like, are disposed at about the focal positions. Each light emitting element 240 illuminates the off-axis reflector segment 220 disposed across the reflector 210 from that light emitting element 240, as indicated by dotted lines in FIG. 7. The light emitting elements 240 can be mounted on sidewalls, ledges, or other support structures disposed at the corners of the perimeter 212. The light emitting elements 240 illuminate their respective off-axis reflector segments 220, which generally collimate and reflect the light out an aperture corresponding to the generally square perimeter 212.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

The appended claims follow:

The invention claimed is:

1. A reflector comprising:

a sidewall defining a perimeter surrounding an interior region; and three or more intersecting curved reflective surfaces disposed in the interior region, each curved reflective surface defining an off-axis reflector segment having a focus disposed at the perimeter and oriented to reflect light emanating from its focus out a reflector aperture defined by the sidewall, the three or more intersecting curved reflective surfaces having at least three lines of intersection.

2. The reflector as set forth in claim 1, wherein the curved reflective surfaces are parabolic reflective surfaces, each parabolic reflective surface defining an off-axis parabolic reflector segment.

3. The reflector as set forth in claim 2, wherein the perimeter is generally circular.

4. The reflector as set forth in claim 3, wherein the three or more intersecting curved reflective surfaces include three intersecting curved reflective surfaces having three lines of intersection.

5. The reflector as set forth in claim 3, wherein the three or more intersecting curved reflective surfaces include three intersecting curved reflective surfaces arranged with a threefold rotational symmetry respective to a center of the generally circular perimeter.

6. The reflector as set forth in claim 1, wherein the sidewall comprises:

a thermally conductive material providing heat-sinking for associated light emitting elements disposed at the foci of the off-axis reflector segments.

7. The reflector as set forth in claim 1, wherein each curved reflective surface is disposed along a portion of the perimeter.

8. The reflector as set forth in claim 7, wherein each curved reflective surface defining an off-axis reflector segment has its focus disposed at a portion other than the portion of the perimeter along which the curved reflective surface is disposed.

9. The reflector as set forth in claim 7, wherein each curved reflective surface defining an off-axis reflector segment has its focus disposed at an opposite side of the perimeter from the portion of the perimeter along which the curved reflective surface is disposed.

10. A reflector comprising:

a sidewall defining a perimeter surrounding an interior region; and a plurality of intersecting curved reflective surfaces disposed in the interior region, each curved reflective surface being disposed along a portion of the perimeter and defining an off-axis reflector, segment having a focus disposed at the perimeter and oriented to reflect light emanating from its focus out a reflector aperture defined by the sidewall, wherein for each of the plurality of intersecting curved reflective surfaces, a line connecting the reflector segment focus and the portion of the perimeter along which the curved reflective surface defining the reflector segment is disposed passes over at least one other reflector segment.

11. A lamp comprising:

a reflector including a plurality of off-axis reflector segments each having a focus at a perimeter of the reflector; and a plurality of light emitting elements disposed at the foci of the off-axis reflector segments;

wherein each off-axis reflector segment has its focus disposed at a perimeter of one or more other off-axis reflector segments.

12. The lamp as set forth in claim 11, wherein the off-axis reflector segments are selected from a group consisting of:

an off-axis parabolic reflector segment, and an off-axis spherical reflector segment.

13. The lamp as set forth in claim 11, wherein the reflector further includes:

a sidewall corresponding to the perimeter of the reflector, the plurality of light emitting elements being disposed on the sidewall.

14. A lamp comprising:

a reflector including a plurality of off-axis reflector segments each having a focus at a perimeter of the reflector; and a plurality of light emitting elements disposed at the foci of the off-axis reflector segments and defocused relative to the off-axis reflector segments to produce a diverging lamp illumination.

15. The lamp as set forth in claim 14, wherein each light emitting element is disposed distal from the off-axis reflector segment at whose focus the light emitting element is disposed.

16. The lamp as set forth in claim 14, wherein each light emitting element is disposed across the reflector from the off-axis reflector segment at whose focus the light emitting element is disposed.

17. The lamp as set forth in claim 14, wherein the reflector further includes:

a sidewall surrounding the plurality of off-axis reflector segments, the plurality of light emitting elements being disposed on an interior of the sidewall.

* * * * *